United States Patent [19]

Marvin

[11] Patent Number: 5,060,999

[45] Date of Patent: Oct. 29, 1991

[54] CUP CARRIER

[75] Inventor: Claire C. Marvin, Park Ridge, Ill.

[73] Assignee: Scypher Corporation, Naperville, Ill.

[21] Appl. No.: 505,158

[22] Filed: Apr. 5, 1990

Related U.S. Application Data

[63] Continuation-in-part of PCT US89/01841, filed Apr. 28, 1989.

[51] Int. Cl.[5] ..... B65D 71/00

[52] U.S. Cl. ..... 294/87.2; 206/150; 206/192; 294/159

[58] Field of Search ..... 294/31.2, 87.1, 87.2–87.28, 294/137, 146, 148, 149, 159, 160, 165; 206/139, 145, 150, 151, 158, 162, 163, 199, 192, 427, 428, 431, 602, 608; 215/100 A; 220/94 R, 94 B; 229/1.5 H

[56] References Cited

U.S. PATENT DOCUMENTS

| | | | |
|---|---|---|---|
| 2,656,959 | 10/1953 | Currie | 206/192 X |
| 2,975,934 | 3/1961 | Powell | 206/192 |
| 3,038,602 | 6/1962 | Rapata | 294/87.2 X |
| 3,268,070 | 8/1966 | Cunningham | 294/87.2 X |
| 3,269,530 | 8/1966 | Wanderer | 294/87.2 X |
| 3,608,949 | 9/1971 | Owen | 294/87.2 |
| 3,653,610 | 4/1972 | Owen | 294/31.2 |
| 3,717,277 | 2/1973 | Stengle, Jr. | 294/31.2 X |
| 3,784,003 | 1/1974 | Bolton | 294/87.2 X |
| 3,830,361 | 8/1974 | Klygis | 206/150 |
| 3,860,112 | 1/1975 | Klygis | 294/87.2 X |
| 4,385,690 | 5/1983 | Olsen | 206/150 |
| 4,385,691 | 5/1983 | Klygis | 206/150 |
| 4,582,215 | 4/1986 | Barrash | 294/31.2 X |
| 4,793,647 | 12/1988 | Marvin | 294/87.2 |
| 4,850,479 | 7/1989 | Bird | 294/87.2 X |

FOREIGN PATENT DOCUMENTS

| | | | |
|---|---|---|---|
| 1349429 | 12/1963 | France | 294/149 |
| 1497625 | 10/1967 | France | 294/159 |

*Primary Examiner*—Johnny D. Cherry
*Attorney, Agent, or Firm*—Baker & McKenzie

[57] ABSTRACT

A cup carrier (10) is provided having a plurality of circular cup engaging portions (12,16,20,24), each supported by support straps (52,56) and bails (30,36) from a handle (28) by which the carrier is to be carried. Doubled back bail portions (36) and doubled back support straps (56) independently support two of the cup engaging portions from the handle (28) so that each cup is supported in a level condition. Stabilizer straps (82) and tear away (40,42,62,68,80) locations ensure that the carrier remains in a generally planar configuration before use. A tear line on the axis of symmetry of one embodiment permits the carrier to be separated into two carriers for two drinks each.

7 Claims, 4 Drawing Sheets

CUP CARRIER

This is a continuation-in-part of PCT application Ser. No. PCT/US 89/01841, filed Apr. 28, 1989.

TECHNICAL FIELD

The present invention relates generally to a carrier formed of a flexible sheet of plastic or like material which is for carrying cup and other articles.

BACKGROUND ART

Various cup carriers and holders are known in the art for carrying a plurality of cups of paper, plastic, or cardboard from a food service facility.

For example, a cup caddy is disclosed in U.S. Pat. No. 4,793,647 having a plurality of cup engaging portions each supported by support webs at generally opposite sides of the cup engaging portions. Some of the support webs are doubled back, and an elongating element is provided in a center support web. T h e known cup carriers are cut from a sheet of plastic so that the support webs and doubled back portions are free. Also, various parts have convex shaped edges, as well as having gradually narrowing spaces between edges. All of these features promote catching and entangling between the cup carriers when several are being handled or stored together. This is of particular significance since such carriers are most often stored and used in quantity. In particular, such cup carriers can hook onto one another much the way a box of clothes hangers tangle so that separation of the cup carriers becomes difficult. Many other flexible carriers experience the same problem since tabs or loose flaps are present.

DISCLOSURE OF INVENTION

The present invention overcomes the problems of the known devices and provides a cup carrier which is inexpensive to manufacture and which is easy to handle, particularly when handled or stored with others so that it doesn't become entangled with other carriers.

Therefore, an object of the present invention is to provide a cup carrier which facilitates handling and stacking with other cup carriers without becoming entangled.

Another object is to provide a cup carrier which is inexpensive, uses a minimum of material, and provides increased stability of the cups being carried.

These and other objects and advantages of the invention are provided in a cup carrier for carrying a number of cups or other articles, such as cylindrically shaped articles having a side taper or an upper lip. The cup carrier is formed of a flat sheet of flexible material which is cut out to provide, in a preferred embodiment, four circular cup engaging portions which are linked to one another and to a carrying handle so that one, two, three, or four cups may be carried in the carrier in a level condition. The links connecting the cup carrying portions to one another as well as bail portions which connect the cup engaging portions to the handle are shaped and connected to hold the device in a planar relationship and to eliminate loose tabs, flaps and corners which catch other cup carriers. Thus, entanglement of the cup carriers with one another and with other articles is avoided.

In particular, the projecting edges of the cup carrier are restrained in the plane of the cup carrier by tear away connections so that loose flaps of material are prevented from moving out of the plane of the carrier. Such tear away connections include stabilizer bars connected between the cup engaging portions and the bail and handle. Additional stabilizer bars are formed as an integral part of a length expansion element in a center support strap. Tear away connections are also provided on folded back bail portions to retain them in the plane of the device.

The quantity of material used in the device is reduced by openings formed at strategic locations in the device. These openings also improve the operation of the device. In particular, openings are provided between adjacent ones of the cup engaging portions so that two stabilizers straps are formed thereby for stabilizing the position of cups held in the cup engaging portions. An additional opening at the base of the device forms a hanger hole by which the device may be suspended for dispensing the carriers at a point of use location. The hanger hole lies between a stabilizer base strap which is tangentially connected between two cup engaging portions to provide a non-convex edge and an intermediate support or cross bar linked to a center support strap. The intermediate support twists or pivots in operation and also is of a dimension to permit adjacent cups to move toward one another for additional stability.

An improved handle is also provided in the device which is wider than the known handles to accommodate the full width of the fingers and also includes a comfort flap which prevents digging of a plastic edge into the fingers during carrying of the device.

A further advantage of the present device is the ability to be converted from, for example, a four cup carrier to a pair of two cup carriers. In particular, the preferred embodiment is symmetrical about a center line with two of the cup engaging portions and their respective support straps being on either side of the center line. By providing a perforated line along the line of symmetry, it is possible to tear the carrier in half, thereby forming two carriers each having the advantages of the original carrier. For example, each of the "half carriers" supports either one or two cups, with each of the cups being supported independently of the other and being supported by links connected generally to opposite sides of the cup engaging portions.

By providing the present carrier with the above-described tear line, the present carrier can be used without being torn to carry up to, for example, four cups in one carrier, or by tearing the carrier along the tear line, two separate drink carriers are provided for carrying up to two cups. Therefore, in a food service facility, for example, a single carrier is torn in half to provide two carriers for two drinks each for two different orders. This provides obvious cost savings, particularly since a carrier with the tear line costs no more to produce than a carrier without the tear line.

As can be seen, the present invention provides many advantages over the known devices. The principles disclosed herein are applicable to other embodiments of carriers without departing from the scope of the invention.

BRIEF DESCRIPTION OF DRAWINGS

The invention will described in more detail with reference to the accompanying drawings, in which.

BEST MODE FOR CARRYING OUT THE INVENTION

Figure 1:
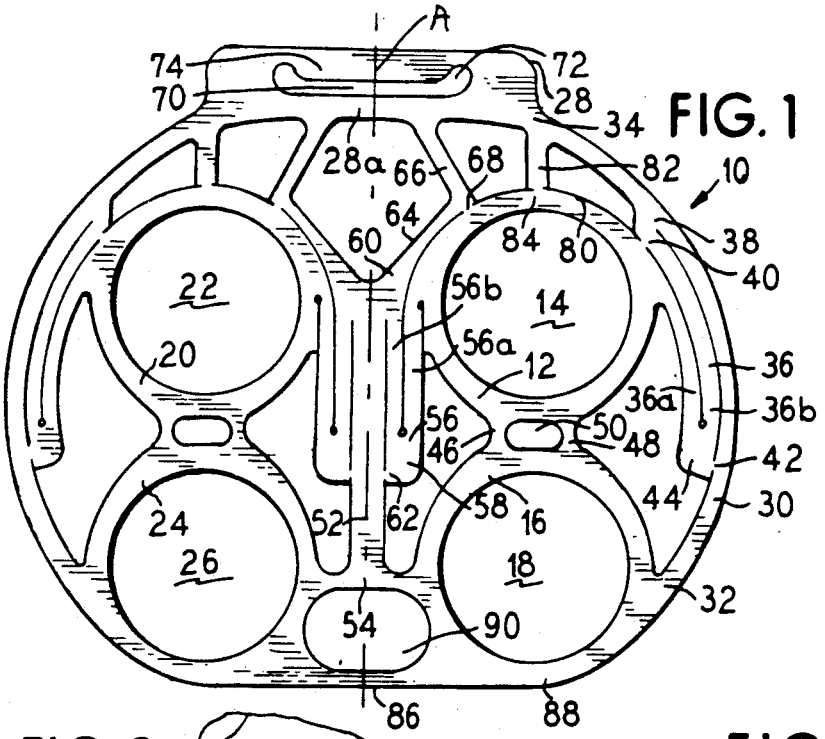
FIG. 1 is a plan view of a cup carrier device according to tne principles of the present invention.

Referring first to FIG. 1, a plan view of the cup carrier 10 is shown which is formed from a sheet of flexible material, such as plastic. The sheet material in a preferred embodiment is a photodegradable polyethylene of a 16 mil thickness. It is also contemplated to use 14 or 18 mil plastic. The device 10 is formed by being cut from a roll of the sheet material, such as by a die cutting apparatus. Since it is of one piece construction with uniform sheet thickness throughout, manufacturing is simplified.

The device includes a first cup engaging portion 12 having a circular opening 14 into which a soft drink cup is received. The cup engaging portion 12 is of a generally circular configuration and is adjacent a second cup engaging portion 16 having a circular central opening 18. The device 10 is symmetrical about a center axis A so that a third cup engaging portion 20 is provided with a central opening 22 which is a mirror image of the first cup engaging portion 12, and a fourth cup engaging portion 24 is provided with a central opening 26 which is a mirror image of the cup engaging portion 16.

Various linkages and supports hold the cup engaging portions 12, 16, 20 and 24 to one another and connect them to a handle 28 for suspended support. In particular, an outer bail 30 extends from the second cup engaging portion 16 to the handle 28. Preferably, an end 32 of the bail 30 is tangentially connected to the cup engaging portion 16. The bail 30 sweeps in an arc around the first cup engaging portion 12 to link to the handle 28 at an area 34.

The first cup engaging portion 12 is connected to the handle 28 by a doubled back bail 36 having two portions 36*a* and 36*b* folded back adjacent one another. The doubled back bail 36 is connected to the outer bail 30 at an area 38 which is spaced from the area 34.

To ensure that the doubled back bale 36 is held in the plane of the device 10, a tear away connection 40 links the region 38 to the first cup engaging portion 12. An additional tear away connection 42 connects the outer bail 30 to a midpoint 44 of the doubled back bail 36. This holds the midpoint 44 in the plane of the outer bail 30. The midpoint 44 is blunt cut so that no portion thereof extends beyond the abutting edges between the outer bail 30 and doubled back bail 36. This prevents the formation of a tab or flap which could be bent out of the plane of the device 10 and catch on other articles.

Between the first and second cup engaging portions 12 and 16 is a pair of stabilizing straps 46 and 48 which hold the cup engaging portions in relation to one another. An opening 50 between the stabilizing straps 46 and 48 provides the straps 46 and 48 with the necessary flexibility to enable small diameter drink cups in the first and second cup engaging portions 12 and 16 to move toward one another by bending or folding of the straps 46 and 48. By having two straps instead of one, the cups C resist twisting or tilting out of position.

A center support 52 is connected to a cross bar 54 extending between the second and fourth cup engaging portions 16 and 24. An opposite end of the center support strap 52 is connected to a doubled back center strap 56 formed of two portions 56*a* and 56*b*. The portion 56*a* is connected to the first cup engaging portion 12 at one end and extends to a midpoint 58 of the doubled back strap 56. The other portion 56*b* extends from the midpoint 58 to a base of an expansion element 60. The second portion 56*b* of the doubled back link 56 has an edge abutting an edge of the center support strap 52. To prevent the midpoint 58 of the doubled back strap 56 from being displaced from the plane of the device 10, a tear away connection 62 is provided. The midpoint 58 of the doubled back strap 56 has a blunt cut limiting end which extends no further than the abutting edges between the strap 52 and the doubled back strap 56. As above, this prevents snagging and entanglement of the device.

The expansion element 60 of the illustrated embodiment is of a pentagonal configuration having a first arm 64 with an edge abutting an outside edge of the first cup engaging portion 12 and a second arm 66 extending from an end of the first arm 64 to the handle 28. A tear away connection 68 is provided at the junction between the arms 64 and 66 and the first cup retaining portion 12 to ensure that the device retains a planar configuration. The second arm 66 is connected to the handle portion 28 at a location spaced from the connection of a corresponding arm on the other side of the device 10.

The handle 28 is connected the bail 30 at location 34 to support the outside edges of the cup engaging portions 12 and 16 and is connected to the arm 66 of the expansion element 60 to support the inside edges of the cup engaging portions 12 and 16. The handle 28 of the illustrated embodiment is wider than the bail 30 with an expanded width portion extending away from the cup engaging portions. A handle slot 70 is formed therein which has upwardly curving ends 72. As a result of the upwardly curving ends 72, a flap 74 is formed which is supported on the fingers of the holder. When picked up for carrying cups, the flap 74 folds upwardly to present a broader surface resting on the fingers.

Although the first cup engaging portion 12 is connected by tear away connections 68 and 40 to the handle and bail, respectively, there still exists a possibility that a portion 80 may catch on other cup carriers and cause entanglement therewith. Thus, to reduce the possibility of such entanglement, a stabilizer bar 82 links the portion 80 of the first cup engaging portion 12 to the region 34 of the outer bail 30 and the handle 28. A tear away connection 84 is provided at the end of the stabilizer bar 82 adjacent the cup engaging portion 12. Thus, the first cup engaging portion 12 is connected at tear away locations 68, 84 and 40 to prevent it from moving out of the plane of the device 10.

At the opposite end of the device 10 is a tangential link 86 extending tangentially between the second cup engaging portion 16 and the fourth cup engaging portion 24. The outer edge of the tangential link 86, also referred to as the stabilizer base strap, is straight to correspond to the straight top edge of the handle 28. This facilitates the cup carrier 10 being cut closely adjacent one another carrier when being cut from a sheet or roll of material, thereby reducing waste.

The tangential link 86 links a region 88 of the second cup engaging portion 16 to a like region of the fourth cup engaging portion 24 so that no point extends beyond the straight edge formed by the link 86, thereby reducing the number of places which the device can become entangled. The link 86 forms a hanger hole 90 through which a hanger or other support may be passed to suspend a stack of the cup carriers 10 for dispensing at a point of sale location.

The features of the right side, with respect to FIG. 1, of the device 10 have been described. As described above, the device 10 is symmetrical about the axis A and thus the same comments apply to the features of the left side as well.

The planar relationship between the portions of the device 10 is important during handling and dispensing of the cup carriers. However, the planar relationship is, of course, not maintained during use of the device. The tear away connections 40, 42, 62, 68 and 84 are torn apart so that the device can move into a shape as shown in FIG. 2.

Figure 2:
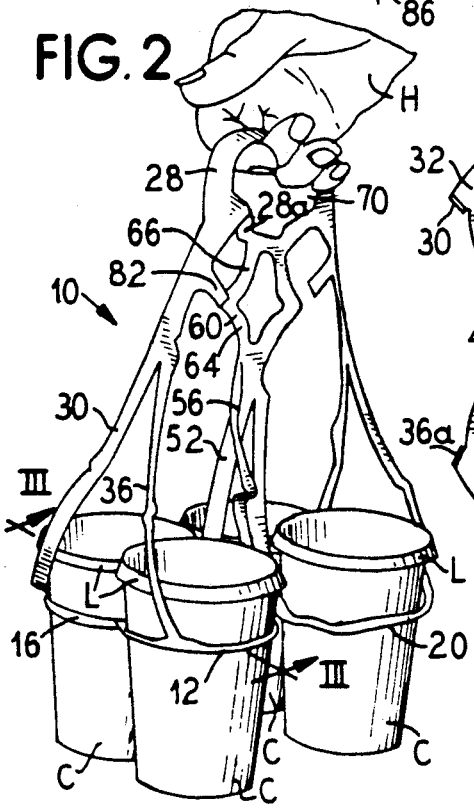
FIG. 2 is a perspective view of a cup carrier of FIG. 1 shown holding four drink cups.

In FIG. 2, the improved cup carrier 10 is shown supporting four drink cups C, each having a snap on lid L. Although drink cups are shown in the illustration, the device can be used to hold and carry any matter of articles which have a generally cylindrical configuration and either have a tapered outer surface or have a lip or ridge at some point along its length. For example, the apparatus can be used to carry cups, glasses, cans, cylindrical parts or tools and can even be used to carry mortar shells and the like. In the illustration, a hand H extends through the slot 70 in the handle 28, the flap 74 being curved or folded upwardly to cushion the fingers. The bail 30 extends from the handle 28 to the second cup engaging portion 16 encircling one of the cups. The opposite side of that cup engaging portion 16 is supported via a lower portion of the handle 28a, the arms 66 and 64 of the expansion element 60 and the center strap 52. The first cup engaging portion 12 encircles another of the cups C and is supported by the doubled back bail 36 and the doubled back center support 56, both of which are at least nearly straightened out by the weight of the cup C in the cup engaging portion 12. The other two cups C are supported in like manner. As can be seen, the expansion element 60 stretches downwardly so that the inside edges of the cup engaging portions 12 and 16 are held level with the outside edges thereof. Also as can be seen, the stabilizer bar 82 is hanging free from the bail 30.

Figure 3:
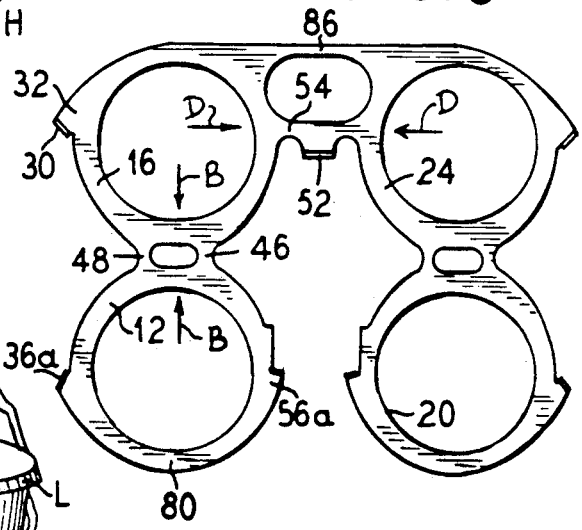
FIG. 3 is a cross section along line III—III of FIG. 2 showing the relationship of the four cups when suspended from the cup carrier.

With reference to FIG. 3, the cup engaging portion 12 is shown supported by the straps 36*a* of the folded back bail 36 and the strap 56*a* of the folded back center support 56. The tear away connections 68, 84 and 40 have been torn away from the portion 80 of the cup engaging portion 12, and the tear away connections 42 and 62 have been torn away from the bail 30 and center strap 52.

The second cup engaging portion 16 is supported from the region 32 by the outer bail 30 and from the opposite side by center strap 52 connected to the cross bar 54. As will be appreciated by those of skill in the art, the weight of the cups C held in the cup engaging portions 12, 16, 20 and 24 when suspended from the handle 28 causes the cups C to move toward one another. This compresses the stabilizer strips 48 and 46 between the first and second cup engaging portions 12 and 16 in the direction of arrows B. The cross bar link 54 and the stabilizer base strip 86 between the second and fourth cup engaging portions 16 and 24 are also compressed in the direction of arrows D. Instead of one connection member between each of the cup engaging portions, the present embodiment provides two connecting strips to stabilize the relative positions of the cups during this compression and prevent tipping and tilting, thereby insuring that the cups C remain in a level condition. The relatively thin stabilizer straps allow the straps to fold or bend without the stiffness associated with thicker straps. This further insures a natural suspended position of the cups. As will also be appreciated by those of skill in the art, the cross bar 54 connected to the center support strap 52 twists along its length when the weight of the cups C in the cup engaging portions 16 and 24 is placed thereon. This spreads the load across the material of the cross bar 54, preventing stress points which lead to stretching and tearing.

Figure 4:
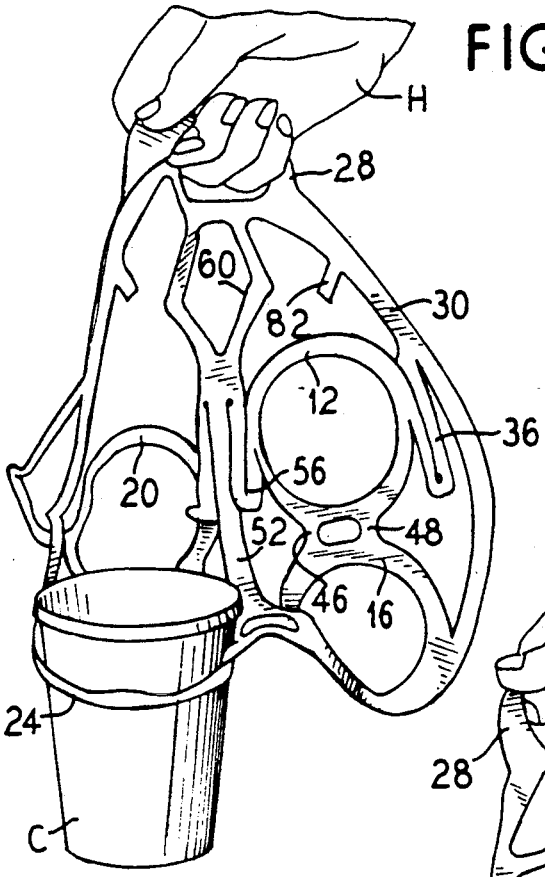
FIG. 4 is a perspective view of the cup carrier of the invention shown holding a single drink cup.
Figure 5:
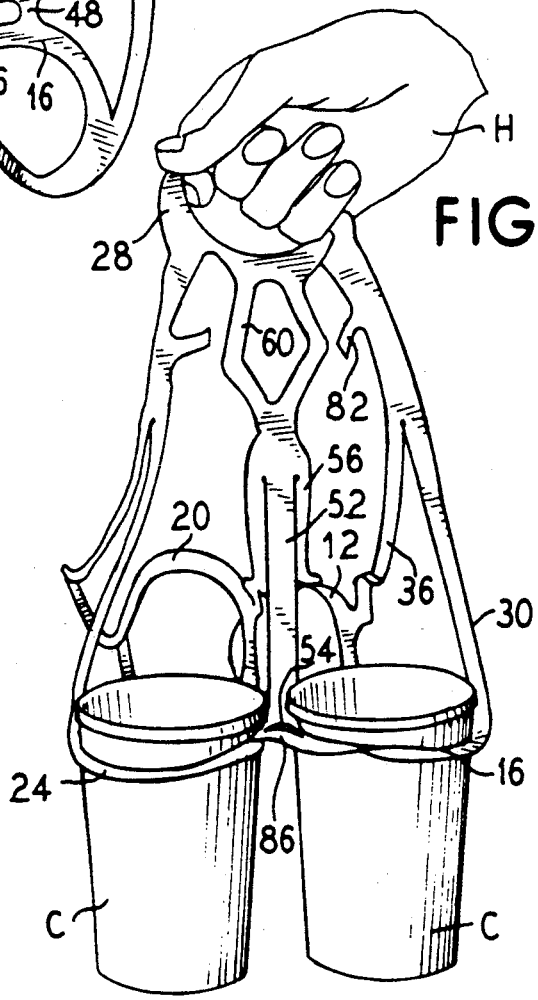
FIG. 5 is a perspective view of the present cup carrier shown holding two drink cups.

In FIGS. 4 and 5 are shown the preferred embodiment of the cup carrier carrying one cup and two cups, respectively. In either situation, the cups C are held in a level, upright position and tipping and spilling of the cup contents is prevented. The cups C are each held generally from opposite sides and the various stabilizers ensure that the cups maintain a suspended level position relative to one another by enabling the material to fold and bend. For example, in FIG. 5 the base strap 86 is curving upward between the cups C and the cross bar 54 is twisting.

Figure 6:
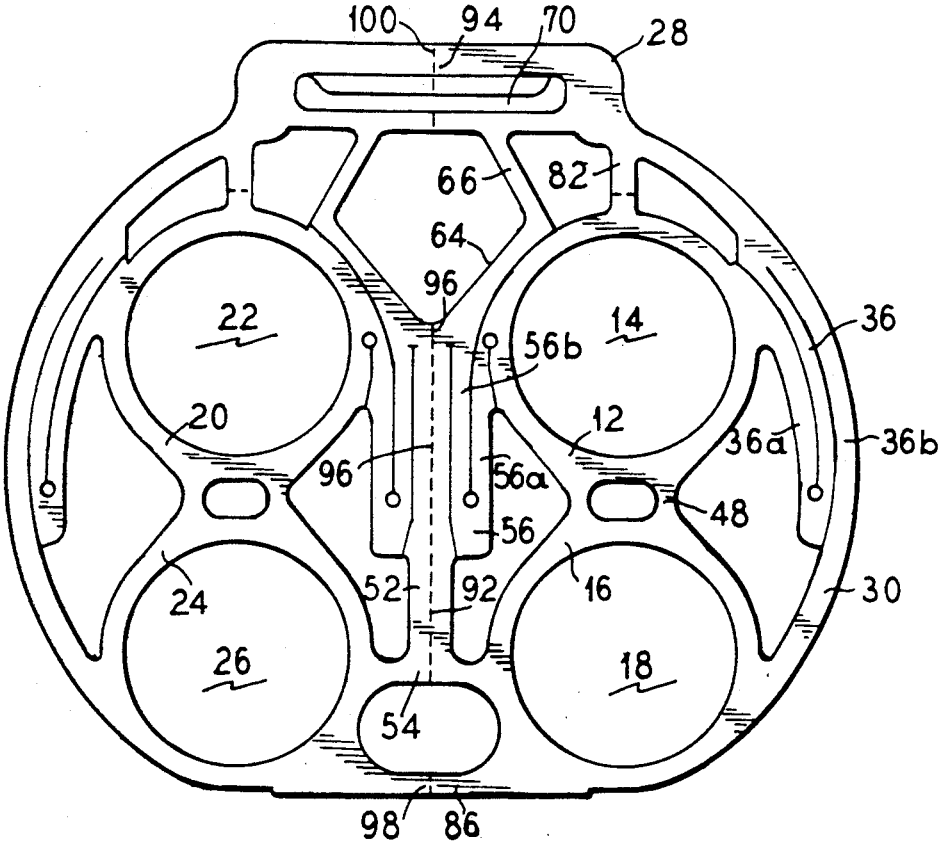
FIG. 6 is a plan view of the present cup carrier with a perforated tear line along its axis of symmetry.

In FIG. 6 is shown a cup carrier that is substantially the same as that shown in FIG. 1 except that a perforated tear line, or frangible boundary, 92 has been added down the middle of the carrier, extending in a vertical direction. Thus, to avoid redundancy, the same reference characters have been used here to refer to the same or similar elements and no further detailed discussion thereof is provided. The tear line 92 includes a portion 94 that cuts the handle 28 in half, a portion 96 that runs down the middle of the center support strap 52, and another portion 98 that extends across the mid-point of the base strap 86. As may be seen in FIG. 6, the carrier is symmetrical about the perforated tear line 92.

The tear line 92 is sufficiently resistant to tearing to prevent it from coming apart during normal use of the carrier, but is sufficiently easy to tear that the two halves of the carrier can be readily separated. To enable the tear line 92 to be more easily torn, each portion 94, 96, and 98 of the tear line has a cut or perforation extending to the edge of the respective portion of the carrier. Thus, a cut 100 at the top edge of the handle 28 is provided in the tear portion 94. Similarly, cuts extend to the edges at the tear portions 96 and 98.

Figure 7:
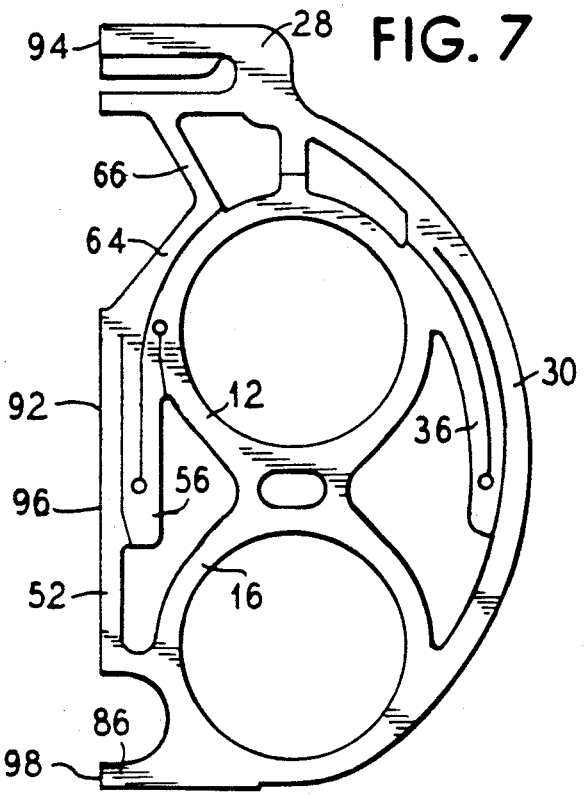
FIG. 7 is a plan view of one half of the carrier of FIG. 6 after being torn in half.

Referring to FIG. 7, the carrier has been torn in half along the tear line 92 so that only two of the cup engaging portions 12 and 16 remain. Not only are the outer bail 30 and the doubled back bail 36 still present, but the tearing of the carrier along the tear line 92 also leaves intact the doubled back center support strap 56. The center support 52 is torn in half, and the half remaining after the carrier is separated supports the cup engaging portion 16 in suspension in a level position just as before the carrier was torn in half.

Figure 8:
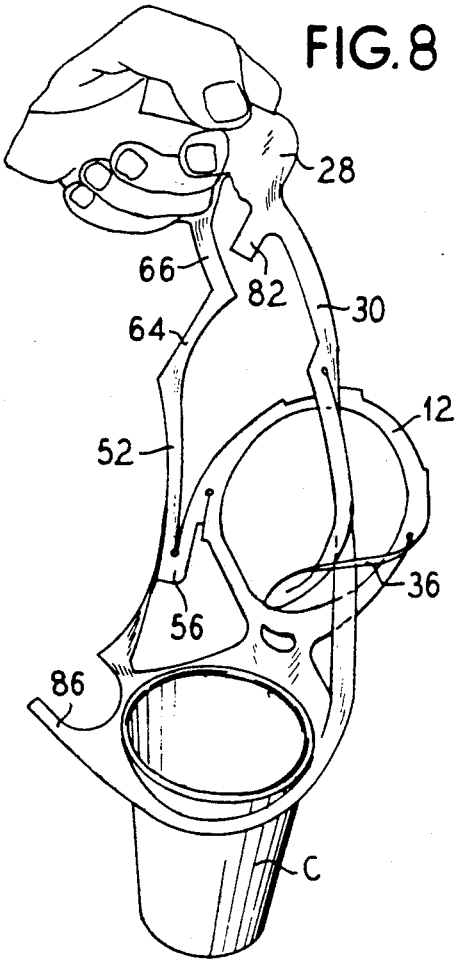
FIG. 8 is a perspective view of the half carrier of FIG. 7 holding a cup in suspension.

FIG. 8 shows the half carrier holding a single cup in suspension from a hand. The cup is supported in the cup engaging portion 16 by the outer bail 30 and by the remaining portion of the center support 52, and the cup remains level even though there is no cup in the other cup engaging portion 12. The cup is supported as well if it is in the cup engaging portion 12.

Tearing the carrier in half as shown in FIG. 7 causes the handle 28 to no longer be useful for supporting the carrier. However, the carrier still may be gripped and supported in suspension as shown in FIG. 8 by placing the fingers under the bail portion at the remaining side of the handle 28.

Figure 9:
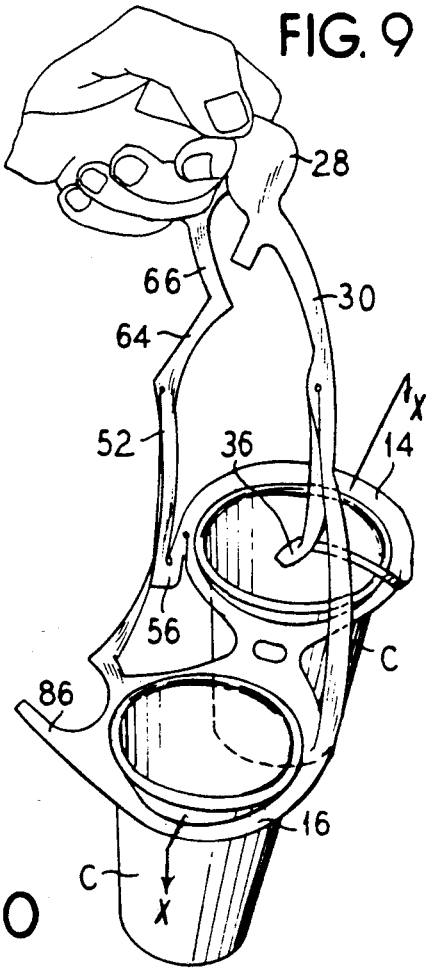
FIG. 9 is a perspective view of the half carrier of FIG. 7 shown holding two cups in suspension.

Two cups are shown in the half carrier of FIG. 9. The first cup in the cup engaging portion 16 is supported as described above, while the second cup in the cup engaging portion 12 is supported independently by the doubled back bail 30 and the doubled back center support strap 56. Either cup can be removed without upsetting the other.

Figure 10:
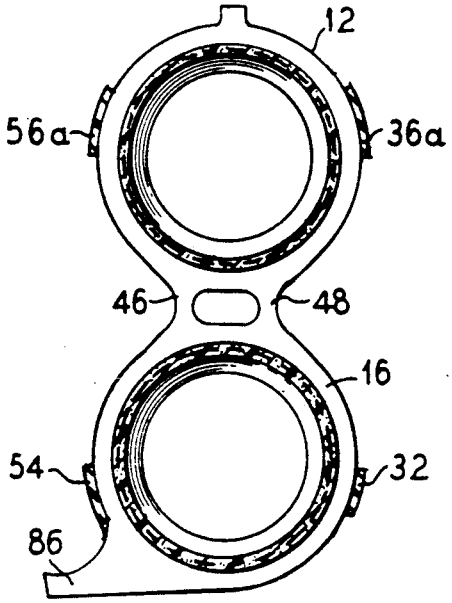
FIG. 10 is a cross section generally along line X—X of FIG. 9 showing the two cups each being supported independently generally at opposite sides.

FIG. 10 illustrates the independent support of each cup in the half carrier. The cup engaging portion 12 is supported generally on opposite sides by the portions 36*a* and 56*a*, while the cup engaging portion 16 is supported by the portions 32 and 54.

Therefore, the carrier can be separated as needed in accordance with the present invention to form two carriers to thereby serve two customers or hold two drink orders, each of no more than two drinks.

Thus, there is shown an improved cup carrier which stabilizes the position of cups being carried therein and which facilitates easy handling when stacked and handled with other cup carriers. It may optionally be used to carry up to four drinks, or to provide two carriers for smaller orders, without stocking two different carriers.

Although other modifications and changes may be suggested by those skilled in the art, it is the intention of the inventor to embody within the patent warranted hereon all changes and modifications as reasonably and properly come within the scope of his contribution to the art.

I claim:

1. A cup carrier for carrying cups, comprising: a flat flexible sheet having cut-outs to form: four circular cup engaging portions (12, 16, 20, 24), first and second of said four cup engaging portions (12, 16) being symmetrically arranged with third and fourth (20, 24) of said cup engaging portions; two linkage members (46, 48) connecting said first cup engaging portion (12) to said second cup engaging portion (16); two further linkage members connecting said third cup engaging portion (20) to said fourth cup engaging portion (24); a base linkage (86) connected tangentially to each of said second and fourth cup engaging portions (16, 24); a cross bar (54) connected between said second and fourth cup engaging portions (16, 24) at a location distinct from said base linkage; a center strip (52) connected to said cross bar (54); arc shaped bail portions (30) extending tangentially from each of said second and fourth cup engaging portions (16, 24); a handle portion (28) extending between said bail portions (30); a length expansion element (60) connected between said center strip (52) and said handle portion (28), said expansion element having portions (64) lying against outer edges of said first and third cup engaging portions (12, 20); tear away locations (68) between said portions (64) of aid expansion element and said first and third cup engaging portions (12, 20); and stabilizer bars (82) extending between said bail portions (30) and each of said first and third cup engaging portions (12,20).

2. A cup carrier as claimed in claim 1, wherein said expansion element (60) is generally of a pentagonal configuration and is connected to said handle portion (28) at two spaced locations.

3. A cup carrier as claimed in claim 1, wherein said base linkage (86) has a substantially flat outer edge, and wherein said handle portion (28) has a substantially flat outer edge to enable a plurality of said carriers (10) to be cut from a sheet in end- to-end relation.

4. A cup carrier as claimed in claim 1, wherein said first and third cup engaging portions (12,20) are connected at outside edges to respective ones of said bail portions by doubled back bail portions (36) and said first and third cup engaging portions (12,20) are connected to said center strip by doubled back center supports (56), said doubled-back bail portions being connected to said bail portions by tear away connections (42) and being square cut at an edge lying adjacent said bail portions, said doubled-back center supports being connected to said strip by tear away connections (62) and having a square cut at an edge end lying adjacent said strip.

5. A cup carrier as claimed in claim 1, wherein said handle portion (28) has a transverse slot (70) having curved slot portions at opposite ends of said transverse slot, said curved slot portions being directed away from said cup engaging portions to form a flap.

6. A cup carrier as claimed in claim 1, further comprising:

a tear line in the form of a perforated line separating ones of said cup engaging portions from others of said cup engaging portions.

7. A cup carrier as claimed in claim 6, wherein said first and second cup engaging portions are separable form said third and fourth cup engaging portions by tearing along said tear line.

* * * * *